US005529521A

United States Patent [19]

Breivik et al.

[11] Patent Number: 5,529,521

[45] Date of Patent: Jun. 25, 1996

[54] LOCKING MECHANISM FOR SECURING A LOADING BUOY TO A VESSEL

[76] Inventors: Kare Breivik, Ugleliveien, N-4120, Tau, Norway; Arne Smedal, Torjusholmen, N-4818, Farvik, Norway

[21] Appl. No.: 244,349

[22] PCT Filed: Mar. 30, 1992

[86] PCT No.: PCT/NO92/00057

§ 371 Date: Aug. 2, 1994

§ 102(e) Date: Aug. 2, 1994

[87] PCT Pub. No.: WO93/11034

PCT Pub. Date: Jun. 10, 1993

[30] Foreign Application Priority Data

Nov. 27, 1991 [NO] Norway ..... 914652

[51] Int. Cl.[6] ..... B63B 72/2

[52] U.S. Cl. ..... 441/5; 114/230

[58] Field of Search ..... 114/230; 441/3, 441/4, 5

[56] References Cited

U.S. PATENT DOCUMENTS

Re. 32,578 1/1988 Poldervaart et al. ..... 441/5

4,490,121 12/1984 Coppens et al. .

4,604,961 8/1986 Ortloff et al. .

4,741,716 5/1988 Hasebe et al. ..... 114/230

4,784,077 11/1988 Idland ..... 114/230

4,892,495 1/1990 Svensen .

*Primary Examiner*—Stephen Avila

*Attorney, Agent, or Firm*—Richard A. Speer

[57] ABSTRACT

A locking and release mechanism for securing a loading/unloading buoy to a vessel. The buoy is of a type to be introduced into a submerged downwardly open receiving space in the vessel and to be fastened in a releasable manner in the receiving space. The locking and release mechanism includes hydraulically actuated locking elements mounted about horizontal axes at the sides of the receiving space to pivot between the locking and releasing positions. The buoy has a peripheral collar with downwardly facing abutment edge for engagement with the locking elements in the locking position thereof.

7 Claims, 5 Drawing Sheets

LOCKING MECHANISM FOR SECURING A LOADING BUOY TO A VESSEL

BACKGROUND OF THE INVENTION

1. Field of the Invention

The invention relates to a locking and release mechanism for securing a loading/unloading buoy on a vessel, wherein the buoy is of the type to he introduced into a submerged downwardly open receiving space in the vessel, and to be fastened in a releasable manner in the receiving space.

2. Background Information

There are previously known various types of submerged buoy structures wherein locking and release mechanisms of the above-mentioned type are used. For example, from U.S. Pat. No. 4,604,961 (corresponds to Norwegian patent No. 167,906) there is known a vessel having a releasable mooring system wherein the vessel has a through-going deck opening, the lower part of the through opening forming a submerged receiving space for a mooring element in the form of a submerged buoy. In the receiving space there is arranged a rotating body (turret) which is rotatably mounted in the hull of the vessel and is designed for receipt and releasable attachment of the buoy. To this end, the buoy is provided with a hydraulically actuated locking mechanism for attachment to the rotating body.

Since the hydraulically actuated locking mechanism in the known system is arranged on the mooring element or buoy, this requires divers for connection of the control hydraulics. Alternatively, a relatively complicated swivel means must be used. Diver operations in connection with connection and disconnection are time consuming and renders the use of the known system as a transport system impossible, when using shuttle tankers. Further, there is a big risk for faulty operations and damages in case of uncontrolled disconnection. Further, a very substantial disadvantage is that, in case of breakage in the hydraulic system, there is no possibility for connection of a back-up or auxiliary device.

In the known locking mechanism, there are used horizontally movable locking pins which are moved in their longitudinal direction for engagement with an abutment surface on the rotating body. This is an unadvantageous solution, since it results in great edge loads on the locking pins and the abutment surface during disconnection, especially in case of unrelieved emergency disconnection, and thereby to deforming stresses.

It is thus a general object of the invention to provide a locking and release mechanism which is without the above-mentioned drawbacks.

A more particular object of the invention is to provide a locking and release mechanism which avoids large edge loads under connection as well as disconnection, also in case of emergency disconnection, and which in addition is self-compensating and results in a uniform clamping, also with an uneven abutment edge for the locking elements.

Another object of the invention is to provide a locking and release mechanism which is fixed in relation to the hull of the vessel, and which therefore does not require any swivel transmissions because of turning movements of the vessel.

A still further object of the invention is to provide a locking and release mechanism which in a simple manner may be supplemented with a safety and/or backup means.

SUMMARY OF THE INVENTION

The above-mentioned objects are achieved with a locking and release mechanism of the introductorily stated type which, according to the invention, is characterized in that the mechanism comprises hydraulically actuated locking elements mounted about horizontal axes at the sides of the receiving space, to pivot between the locking and releasing positions, the buoy having a peripheral collar having a downwards facing abutment edge for engagement with the locking elements in the locking position thereof.

The invention will be further described below in connection with exemplary embodiments with reference to the drawings, wherein

DESCRIPTION OF THE PREFERRED EMBODIMENTS

Figure 1:
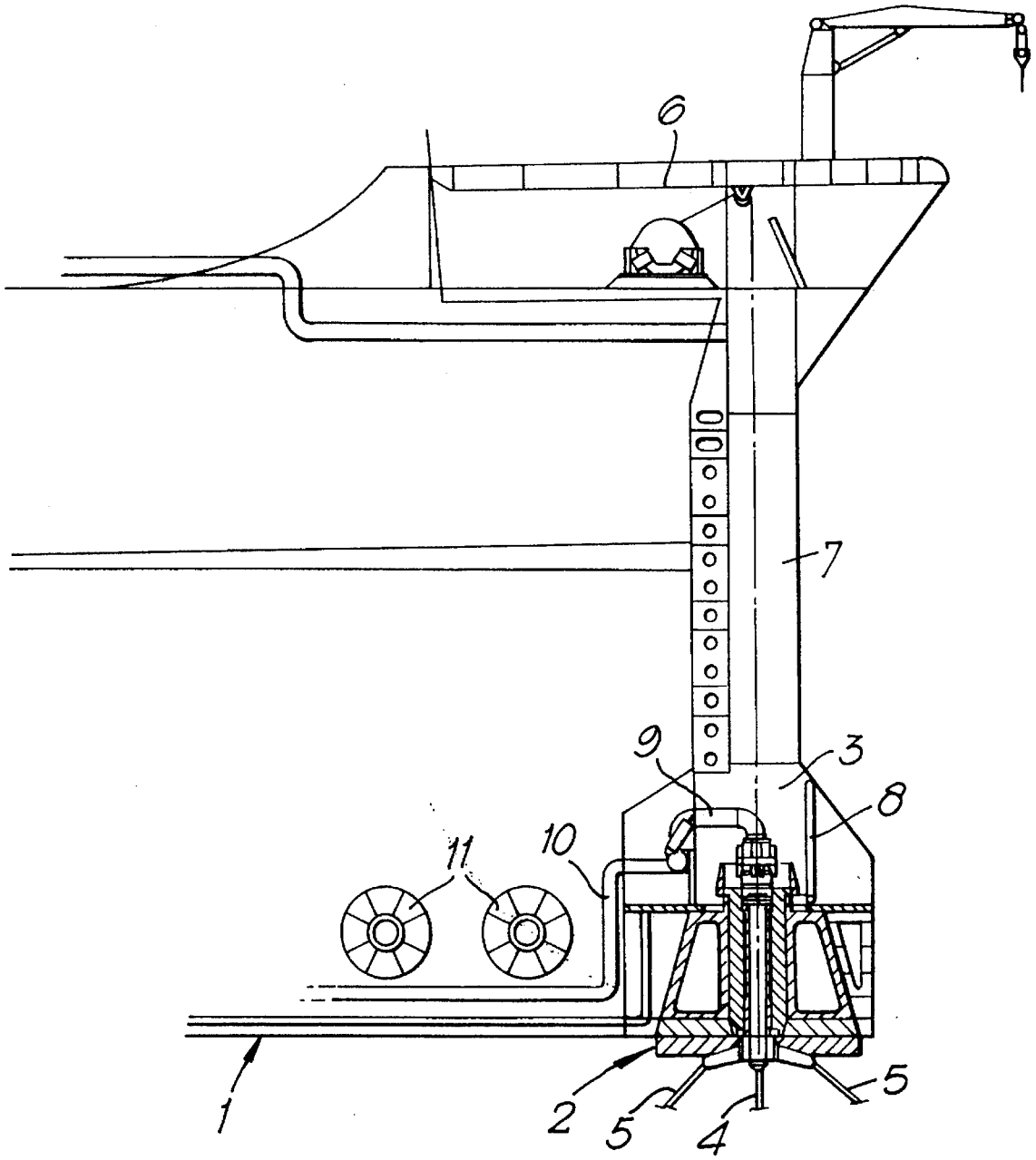
FIG. 1 shows a partial side view of a vessel having a receiving space receiving a buoy and which is provided with a locking and release mechanism according to the invention.

In the vessel 1 shown in FIG. 1, a buoy 2 is received in a submerged receiving space 3 which is a part of a module which is arranged in the lower part of the bow of the vessel. The buoy is of the submerged type and is especially intended for transfer of flowable medium, especially hydrocarbons, to or from tanks on board a tanker. For this purpose the buoy is connected to a flexible transfer line 4, and further is anchored to the sea bed by means of a number of mooring lines suggested at 5. The receiving space 3 is connected with the deck 6 of the vessel through an access or service shaft 7. In the receiving space there is arranged a shutter 8 for shutting off the service shaft 7 and the upper part of the receiving space 3 from the sea when the receiving space is not in use, i.e. when it does not receive a buoy 2. This gives a possibility for inspection of equipment which will be arranged in the upper part of the receiving space, such as sensors and TV cameras for monitoring and control purposes.

The buoy 2 and the lower part of the receiving space 3 have a mating, conical shape, to ensure correct positioning of the buoy in the receiving space when the buoy is hoisted up and introduced in the receiving space.

As appears from FIG. 1, in the upper part of the receiving space 3 there is arranged a coupling unit 9 which, in operation, is coupled to the buoy 2, and which further is connected to a tube system 10 leading to tanks (not shown) on board the vessel 1. The construction of the buoy and said coupling unit will be described briefly with reference to FIG. 2. For a further description of these elements, reference is made to the simultaneously filed international patent applications Nos. PCT/N092/00054 which corresponds to U.S. patent application Ser. No. 08/244,348, filed Aug. 8, 1994 and PCT/N092/00056 which corresponds to U.S. patent application Ser. No. 08/244,440, filed Aug. 8, 1994.

Figure 2:
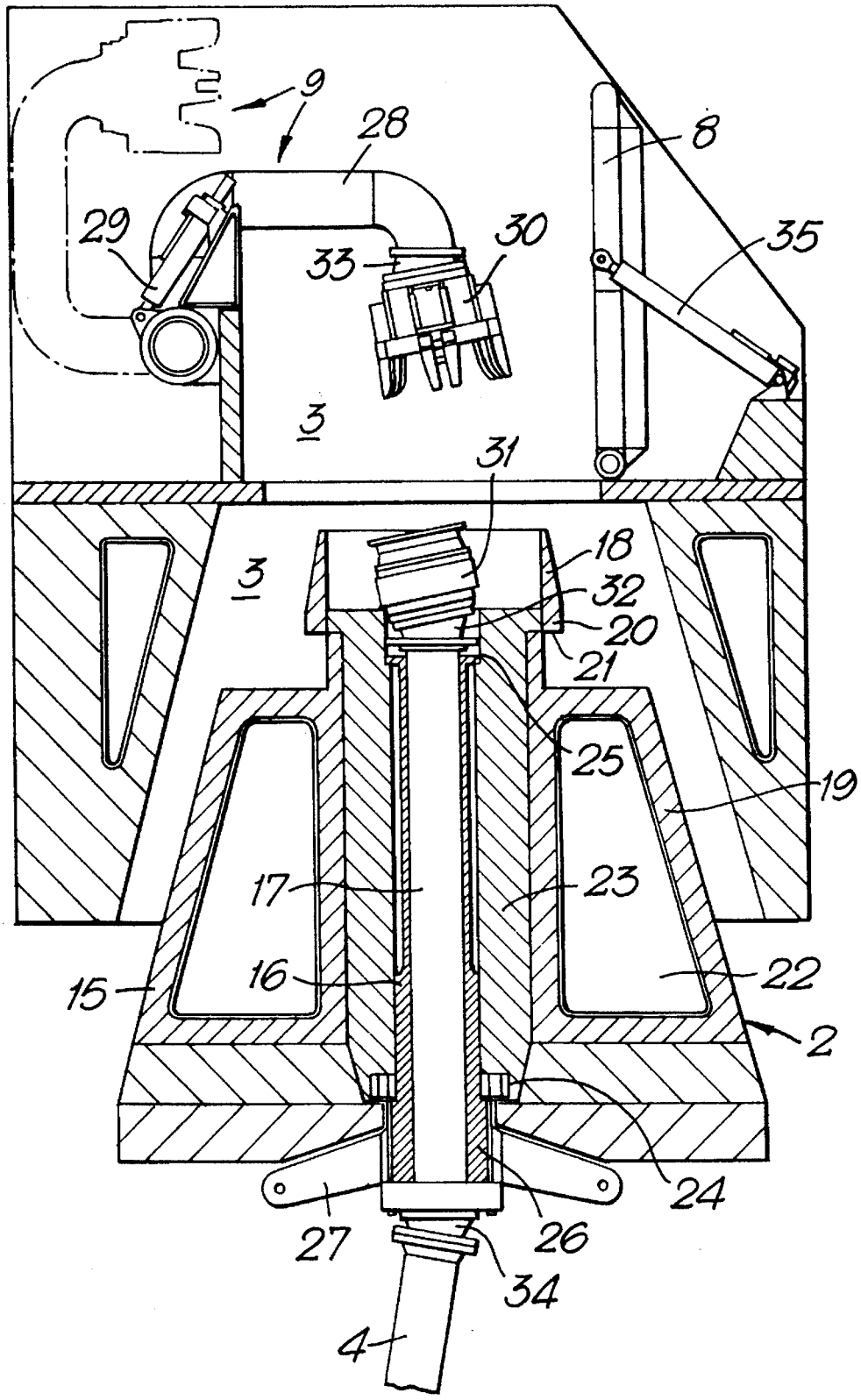
FIG. 2 shows a sectional side view of a receiving space in a vessel and a buoy adapted thereto.

As shown in FIG. 2, the buoy consists of an outer buoyancy member 15 and a central member 18 which is rotatably mounted in the outer member and has a through-going passage 17 for medium to be transported via the buoy. As shown in the Figure, the outer buoyancy member 15 comprises an upper and a lower cone member 18 and 19, respectively, and the upper cone a member comprises a collar 20 having a downwardly facing annular abutment edge 21 for engagement with locking elements forming part of the locking and release mechanism according to the invention. This is arranged in the receiving space 3 and will be described below with reference to FIGS. 3–6.

The outer buoyancy member 15 is divided into several water-tight buoyancy chambers 22, and it further comprises a central replaceable bearing support member 23 having a lower radial bearing 24 and an upper axial bearing 25 for the central member 18. When required, the bearing support member 23 can be lifted up from the outer buoyancy member 15 for inspection and possible replacement of parts.

The central member 16, which here has the form of a hollow shaft, is provided with a lower reinforced portion 26 having a number of outwardly projecting arms 27 for attachment of the mooring lines 5 of the buoy 2 (not depicted in FIG. 2).

The coupling unit 9 in the upper part of the receiving space 3 comprises a curved coupling tube 28 which, by means of a hydraulic cylinder 29, is pivotable between a stowed position and a connecting position (both positions shown in FIG. 2), one end of the tube being provided with a coupling head 30 for connection to the upper end of the central member 16 of the buoy when the buoy is in place in the receiving space. This connection takes place through a swivel means 31 which, in the illustrated embodiment, is coupled to the central member 16 through a flexible joint 32. Also the coupling head 30 comprises a flexible joint 33. In the illustrated embodiment there is also arranged a third flexible joint 34 which is inserted between the lower end of the central member 16 and the transfer line 4 of the buoy. The flexible joints may, for example, be ball joints. The flexible joints 32 and 33 especially are arranged for accommodating fairly large dimensional tolerances when connecting the buoy to different vessels, whereas the flexible joint 34 provides for moment-free transfer of forces from the transfer line 4 to the buoy, and in addition facilitates the positioning of the buoy relative to the receiving space 3, so that the buoy slides easily in place therein.

The aforementioned closing shutter 8 in the upper part of the receiving space 3 is shown to be operated by a hydraulic cylinder 35.

Figure 3:
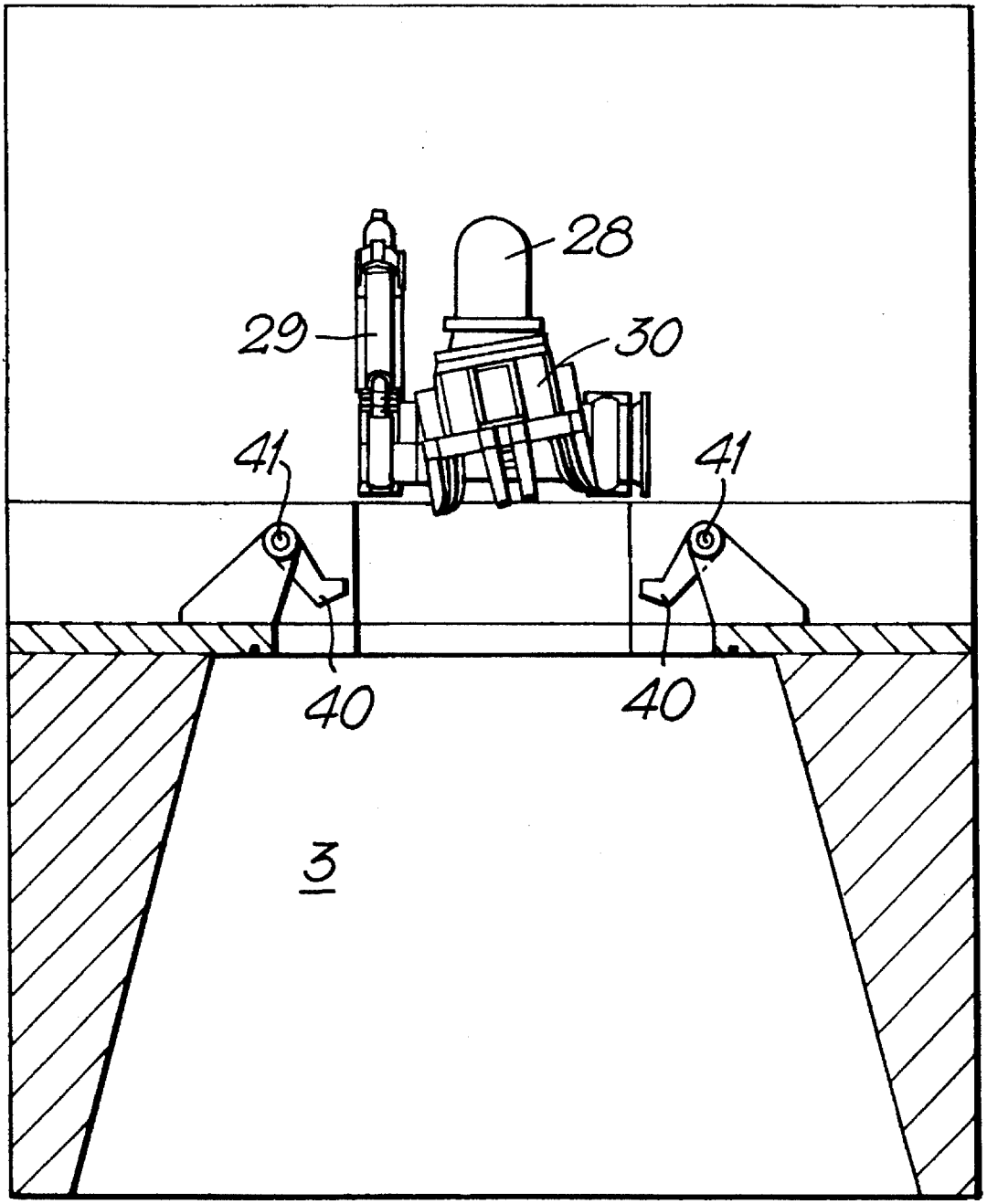
FIG. 3 shows a schematic side view of the receiving space in FIG. 2, at right angles to the sectional plane in FIG. 2.

The locking mechanism for releasable locking of the buoy when it is in place in the receiving space 3, is schematically shown in FIG. 3. In the illustrated embodiment the mechanism comprises a pair of locking dogs 40 which are actuated by a hydraulic system and are rotatable about horizontal axes 41 at diametrically opposite sides of the receiving space 3. When activating the locking dogs 40, these will pivot in a vertical plane into engagement with the downwards facing abutment edge 21 of the upper cone member. The locking dogs 40 provide for rigid locking of the outer buoyancy member 21 of the buoy to the receiving space 3, and the vessel 1 then is allowed to turn about the central member 16 which is rotatably mounted in the outer member 15, the swivel means 31 allowing such turning after the coupling tube 28 having been coupled to the buoy.

The locking mechanism of course may comprise more than two locking elements or locking dogs which are arranged around the circumference of the receiving space. The locking dogs suitably may be operated by hydraulic actuators, e.g. hydraulic cylinders, which are connected in parallel to the hydraulic drive system, so that the mechanism is self-compensating and results in a uniform clamping, also in case of an uneven abutment edge for the locking dogs. If desired, a pneumatic drive system may be used instead of a hydraulic one.

The locking dogs suitably may be arranged to be driven by actuators arranged outside of the receiving space 3 in an accessible safe area. When the vessel 1 is provided with bow thrusters 11 as shown in FIG. 1, this area for example may be accessible from the thruster space of the vessel.

For safety reasons the locking mechanism conveniently may be of the so-called triple redundancy type, which means that, in addition to the main drive system, there are arranged a pair of safety mechanisms in case of failure. Such a safety mechanism may consist in that the actuator mechanism is self-locking, for example in that a link arm is moved past a tilting point and thereafter is prevented from further movement. In this manner the locking is made independent of a possible failure of the hydraulic pressure to the actuator. The normal release will take place in that the actuators are activated for release in case this function should fail, however, there may be arranged a backup system in the form of e.g. hydraulic or pneumatic actuators.

Figure 4A:
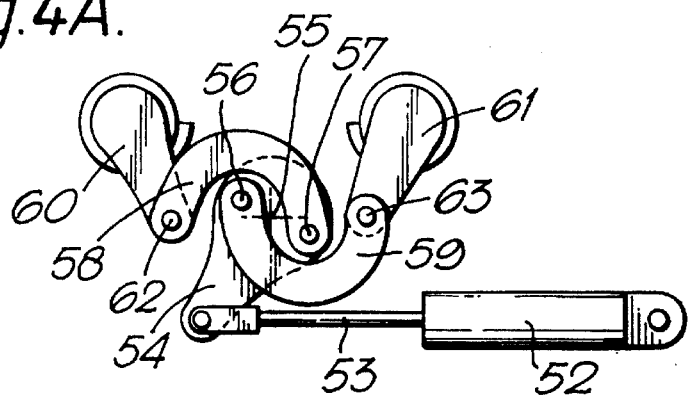
FIGS. 4, 5 and 6 show different embodiments of safety means.
Figure 4B:
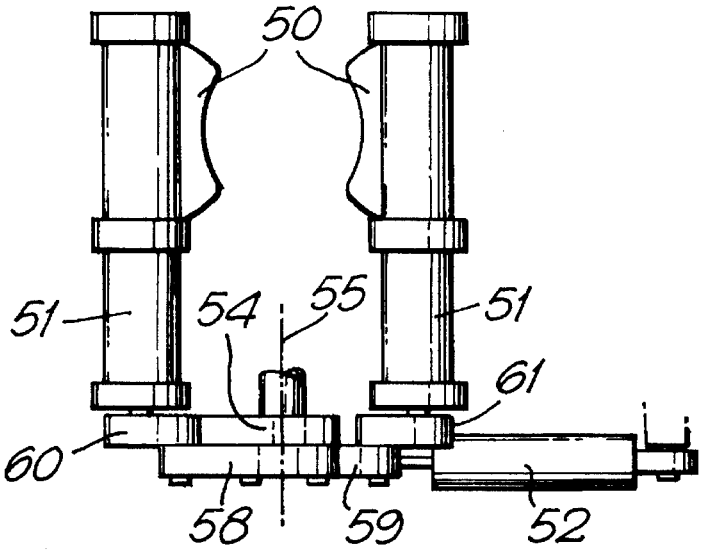
Figure 4C:
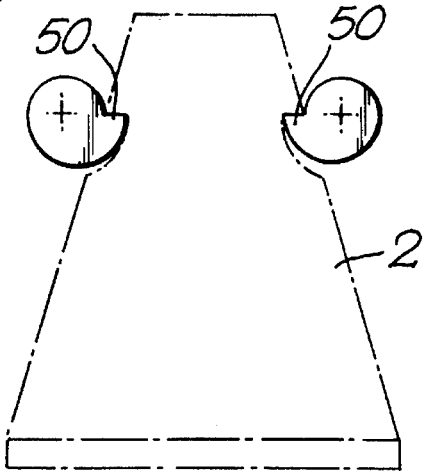
Figure 5:
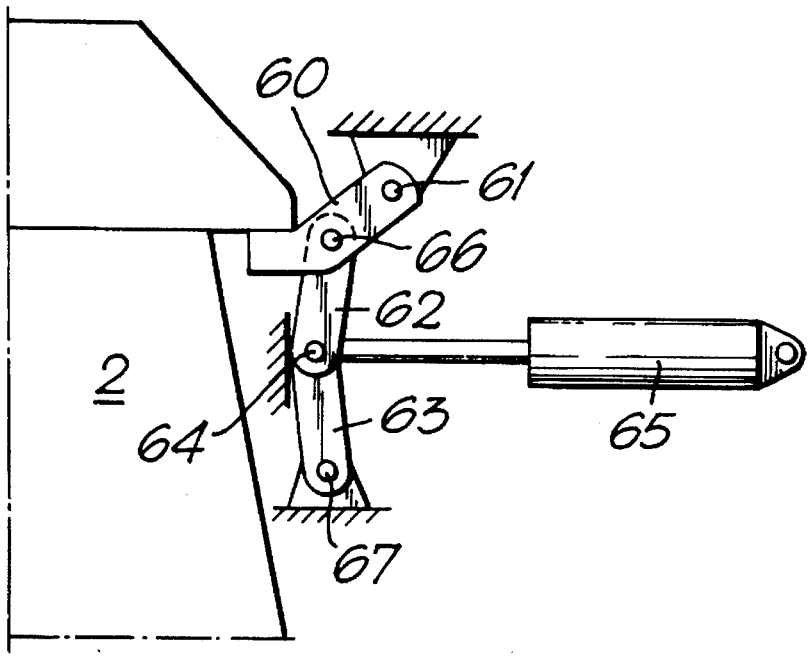
Figure 6:
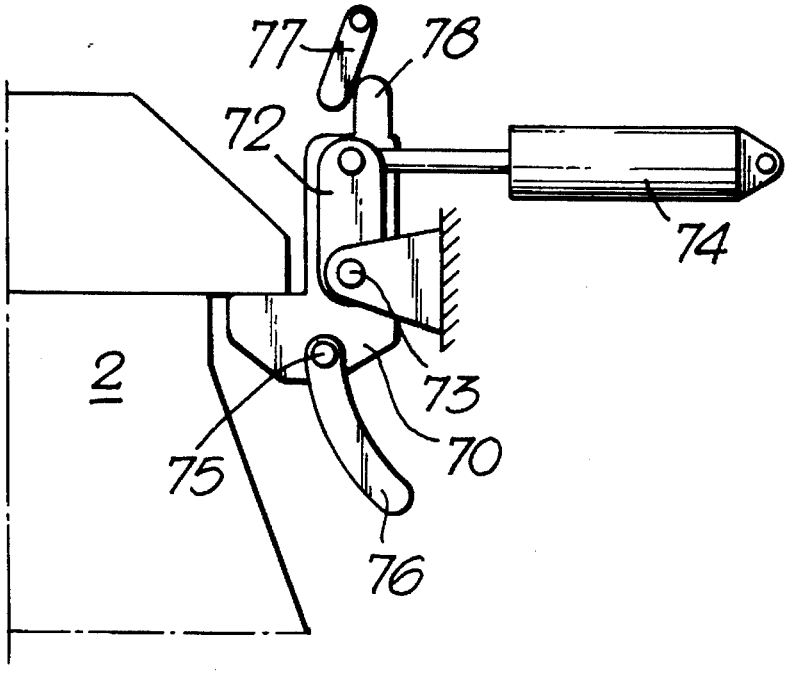

Some examples of safety means for the locking and release mechanism are shown in FIGS. 4–6.

In the embodiment shown in FIGS. 4A–4C, a pair of locking elements 50 are arranged on a respective one of a pair of parallel shafts 51 mounted at opposite sides of the receiving space, to be able to lock a buoy 2 as shown in FIG. 4C. The shafts 51 are driven by a hydraulic cylinder 52 having a piston rod 53 which is connected to the shafts 51 via a self-locking linkage. Thus, the end of the piston rod 53 is articulated to a disk 14 which is rotatable about an axis 55 and which, at diametrically opposite points 56 and 57, is articulated to a pair of link arms 58, 59 which in turn are articulated to additional arms 60, 61 in fulcrums 62 and 63, respectively, as shown in FIG. 4A. The arms 60 and 61 are rigidly connected to a respective one of the shafts 51

In operation, the cylinder 52 rotates the disk 54 about the axis 55. The disk transfers the rotation to the link arms 58 and 59 which, by way of the arms 60 and 61, rotates the shafts 51. The shafts then rotate synchronously. In the locking position the shafts 51 are mechanically locked in that the articulation points of the link arms 58, 59 are moved "over centre" in relation to the axis of rotation 55 of the disk.

In the embodiment in FIG. 5, a locking dog 60 for locking of a buoy 2 is mounted about an axis 61 and in addition is coupled to a toggle joint consisting of a pair of link arms 62, 63 which are interconnected in a joint 64. A hydraulic cylinder 65 is coupled to the joint 64, so that the locking dog 60 is operated through the toggle joint. The mechanism is locked in that the joint 64 of the link arms is brought over centre in relation to the joints 66, 67 at the other ends of the link arms.

FIG. 6 shows an embodiment wherein a locking dog 70 for the locking of a buoy 2 at its upper end is articulated in a fulcrum 71 to one end of a tilting link 72 which, at its other end, is pivotable about a stationary axis 73. In the fulcrum 71, the locking dog 70 and the tilting link 72 are also connected to the end of a piston rod in a rotatably mounted hydraulic cylinder 74. At its other end the locking dog 70 is provided with a guide pin 75 running in a guide 76 for controlling the movement of the locking dog. Instead of the illustrated guide and guide pin, the lower end of the locking dog alternatively may be articulated to a rotatably mounted arm (not shown) guiding the lower end portion of the locking dog along a circular path essentially corresponding to the guide 76.

When released from the illustrated locking position, the hydraulic cylinder 74 turns the tilting link 72 (clockwise)

about the axis 73, so that the locking dog 70 is tilted out from the locking position. As an additional security there is suggested a means for alternative, mechanical release. This is in the form of an arm 77 which is rotatable against a lug 78 on the locking dog 70 for tripping the locking dog, so that the latter is tilted out from the locking position in a corresponding manner as under the influence of the hydraulic cylinder.

We claim:

1. A locking and release mechanism for securing a loading/unloading buoy in a submerged downwardly open receiving space in a floating vessel said mechanism comprising:

a plurality of locking elements, mounting means mounting said locking elements for pivoting about horizontal axes in said receiving space between locking and release positions, the locking elements pivoting upwardly into said locking position, drive means for driving said locking elements between said locking and release positions, and a peripheral collar on said buoy, said collar having a downwards facing abutment edge engageable by said locking elements in the locking position thereof, (wherein) said locking elements being (are) free when driven to said release position by (on release of) said drive means to move downwardly and away from said abutment edge, and said drive means including locking arms adapted for mechanical locking of respective ones of said locking elements in the locking position, in case of a failure in said drive means.

2. The mechanism of claim 1 wherein said drive means comprises hydraulic actuators for actuating said locking arms, said hydraulic actuators being located externally of said receiving space.

3. The mechanism of claim 2 wherein said hydraulic actuators are connected in parallel in an hydraulic drive system.

4. The mechanism of claim 3 further comprising backup means for release of said locking elements in the event of failure of said hydraulic system.

5. The mechanism of claim 4 wherein said backup means comprises an hydraulic accumulator.

6. The mechanism of claim 1 wherein said locking elements comprise a pair of dogs, said mounting means mounting said dogs at positions diametrically opposed across said receiving space.

7. The mechanism of claim 1 further comprising backup means for release of said locking elements in the event of failure of said drive means.

* * * * *

UNITED STATES PATENT AND TRADEMARK OFFICE

CERTIFICATE OF CORRECTION

PATENT NO. : 5,529,521

DATED : June 25, 1996

INVENTOR(S) : Kare Breivik & Arne Smedal

It is certified that error appears in the above-indentified patent and that said Letters Patent is hereby corrected as shown below:

Col. 3, line 11, Delete the numeral "18" and substitute the numeral -16-

Col. 4, line 18, After "release" insert a period - . -

Col. 4, line 18, Delete "in" and substitute - In -

Col. 4, line 30, Delete the numeral "14" and substitute the numeral -54-

Col. 4, line 35, After the numeral "51" insert a period -.-

Claim 1, lines 25 and 26, Delete the parentheses and the words in the parentheses.

Signed and Sealed this

Seventeenth Day of December, 1996

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT : 5,529, 521

DATED : June 25, 1996

INVENTOR(S) : Breivik et al.

It is certified that error appears in the above-identified patent and that said Letters Patent is hereby corrected as shown below:

Title page, insert item [73], Den Norske Stats Oljeselskap A.S. Stavanger, Norway.

Signed and Sealed this

Twenty-fifth Day of March, 1997

*Attest:*

Bruce Lehman

BRUCE LEHMAN

*Attesting Officer*

*Commissioner of Patents and Trademarks*